US005358015A

United States Patent [19]

Hacker et al.

[11] Patent Number: 5,358,015

[45] Date of Patent: Oct. 25, 1994

[54] DRAW-THROUGH GRIPPER FOR THE INSERTION OF AN AUXILIARY WEFT THREAD INTO A SEAM-WEAVING SHED

[75] Inventors: Hans E. Hacker; Peter Defranceski; Norbert Kohfink, all of Reutlingen, Fed. Rep. of Germany

[73] Assignee: Novatech GmbH Siebe und Technologie fur Papier, Reutlingen, Fed. Rep. of Germany

[21] Appl. No.: 149,729

[22] Filed: Nov. 10, 1993

[30] Foreign Application Priority Data

Nov. 13, 1992 [DE] Fed. Rep. of Germany ..... 9215498

[51] Int. Cl.[5] ..... D03D 47/16

[52] U.S. Cl. ..... 139/383 AA; 139/447

[58] Field of Search ..... 139/383 AA, 447; 28/141

[56] References Cited

U.S. PATENT DOCUMENTS 4,985,970 1/1991 Kronkel et al. ..... 139/383 AA X 5,027,483 7/1991 Anderson ..... 139/383 AA X 5,183,081 2/1993 Kuster et al. ..... 139/383 AA X

FOREIGN PATENT DOCUMENTS 0043441 6/1981 European Pat. Off. .

0236601 9/1987 European Pat. Off. .

8122449 1/1983 Fed. Rep. of Germany .

4133374 4/1993 Fed. Rep. of Germany .

*Primary Examiner*—Andrew M. Falik

*Attorney, Agent, or Firm*—Sughrue, Mion, Zinn, Macpeak & Seas

[57] ABSTRACT

A draw-through gripper for the gripping and insertion of an auxiliary weft thread into a seam-weaving shed in a seam-weaving machine includes a movable gripper arm with a gripping collet for grasping the auxiliary weft thread. An apparatus for measuring the mechanical stress occurring inside the gripper arm is mounted on the gripper arm. The apparatus for measuring the mechanical stress occurring within the gripper arm can be a strain gauge.

4 Claims, 5 Drawing Sheets

DRAW-THROUGH GRIPPER FOR THE INSERTION OF AN AUXILIARY WEFT THREAD INTO A SEAM-WEAVING SHED

BACKGROUND OF THE INVENTION

The invention relates to a draw-through gripper for the insertion of an auxiliary weft thread into the seam-weaving shed in a seam-weaving machine. The gripper has a movable gripping arm with a gripping collet for grasping the auxiliary weft thread.

Industrial plastics woven fabrics for uses in which a very regular surface structure of the woven fabric is required, especially flat-woven plastics paper-forming fabrics, are made endless by a woven seam. To produce a woven seam, warp threads are exposed to a length of e.g. 15 cm at the woven fabric ends which are to be joined to each other, the weft threads in this zone being removed. The so-called woven seam, in which the original weave binding is exactly reproduced, is then formed from these warp thread fringes and the weft threads removed from the woven fabric end. An auxiliary weaving shed or seam-weaving shed is spread out from the removed weft threads, in which the removed weft threads function as auxiliary warp threads. The warp thread fringes are inserted into this seam-weaving shed as auxiliary weft threads alternately from the two woven fabric ends.

Of the plurality of warp thread fringes projecting from every woven fabric end, one warp thread fringe is singled out and held fast by means of a separator (DE-U-87 13 074, EP-A-0 301 174 and DU-U-90 02 278). A handover gripper transports this warp thread fringe to a draw-through gripper which then inserts it as an auxiliary weft thread into the seam-weaving shed, so that the auxiliary weft thread initially lies taut in the seam-weaving shed. The draw-through gripper is of the design mentioned initially and is known e.g. from DE-U-81 22 449, EP-A-0 043 441 and EP-A-0 236 601. The draw-through gripper is so designed in modern seam-weaving machines that it simultaneously checks for the presence of the warp thread fringe, so that woven-seam faults which would result from a missing warp thread fringe are avoided. If a warp thread fringe is missing, the seam-weaving machine is stopped so that the fault can be eliminated at once and substantial reworking thereby avoided. To monitor the presence of a warp thread fringe, the griping collets of the draw-through grippers are usually designed as electrical switches with two switch contact surfaces which touch one another when there is not warp thread fringe and thereby complete an electrical circuit. If, on the other hand, a gripping collet has grasped a warp thread fringe which is made of plastics material and is thus an insulator, this lies between the two contact surfaces, so that the electrical circuit is not completed and consequently no signal is issued. However, there is a problem in that dirt forms in the gripping collets and thus also in the switch, which after an unforeseeable period hampers the monitoring function, as the dirt acts as an insulator. The seam-weaving machine then continues to operate despite the absence of a warp thread fringe.

A further problem resides in the fact that when there is a break in the electrical signal line the monitoring function ceases, i.e. the electrical circuit can no longer be completed even if there is no warp thread fringe.

SUMMARY OF THE INVENTION

The object of the invention is to improve the reliability of the mode of operation of a seam-weaving machine.

According to the invention, this object is achieved in that the gripping arm of the draw-through gripper has an apparatus for measuring the mechanical stress present inside the gripping arm.

Because the presence of a warp thread fringe is no longer established direct, but the mechanical stress occurring inside the griping arm is measured, a dirtying of the gripping collets no longer leads to an incorrect message. The stress occurring upon the insertion of the auxiliary weft thread into the seam-weaving shed and in particular the jerk occurring towards the end of this process, which is caused by the drawing tight of the auxiliary weft thread in the seam-weaving shed, are largely independent of a dirtying of the gripping collets.

A major advantage of the invention resides in the fact that the measurement of the bending moment produces a quantitative statement concerning the force with which the auxiliary weft thread is incorporated into the weaving shed. This tensional force is of decisive importance for the quality of the woven seam. A reproducibility of this tensional force is made possible by the invention.

The mechanical stress occurring within the gripping arm is preferably measured by strain gauges which are attached to the surface of the gripping arm.

For preference, the draw-through gripper is mounted for rotary movement at one end of the gripping arm, the gripping collet is located at the other end of gripping arm and the strain gauges are attached at the greatest possible distance from the rotation point.

In a preferred version of the invention, strain gauges are arranged at opposite points on the outside of the rotating arm, so that both the compressive force resulting from the bending moment and the tensional force are determinable and the measurement signal can thus be amplified.

An embodiment of the invention is described below with reference to the drawings.

DETAILED DESCRIPTION OF THE INVENTION

Figure 1:
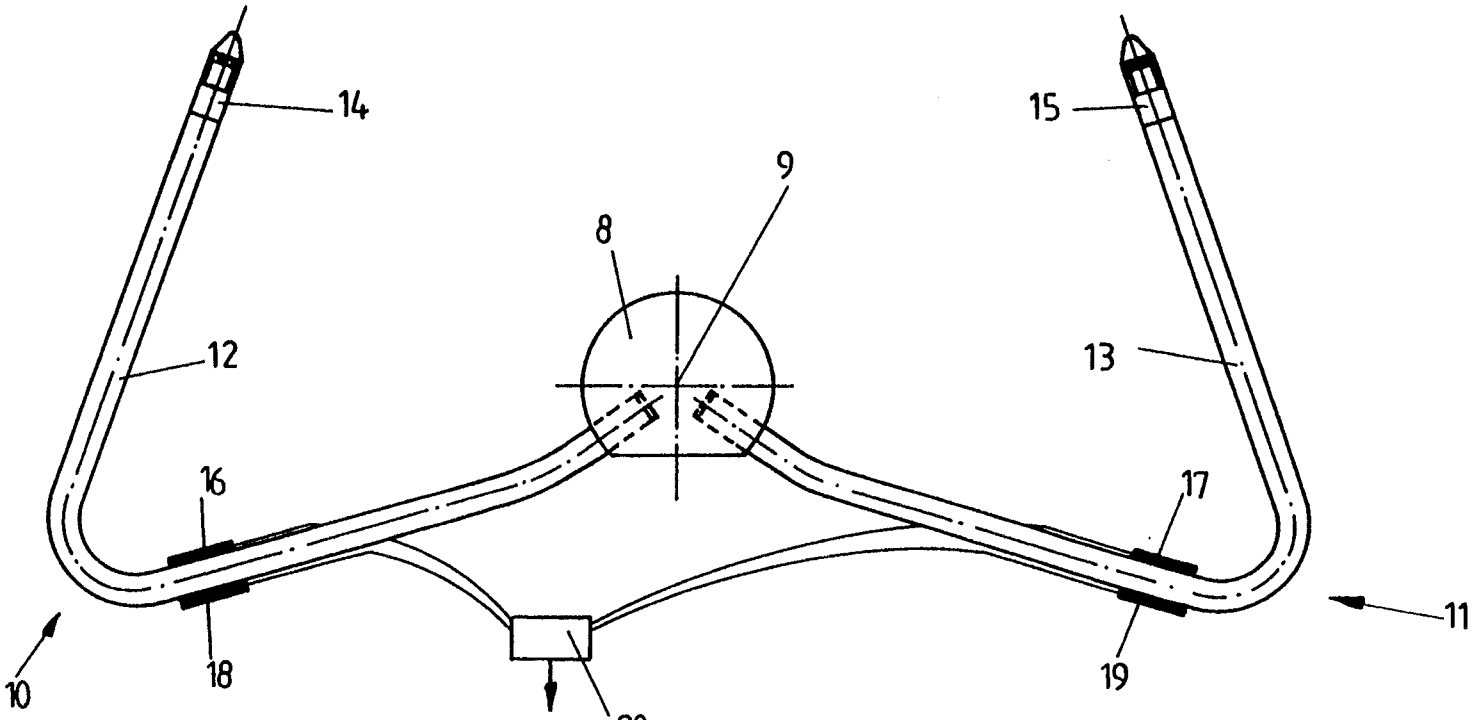
FIG. 1 is a top plan view of draw-through gripper, without representation of the woven fabric to be made continuous.
Figure 2:
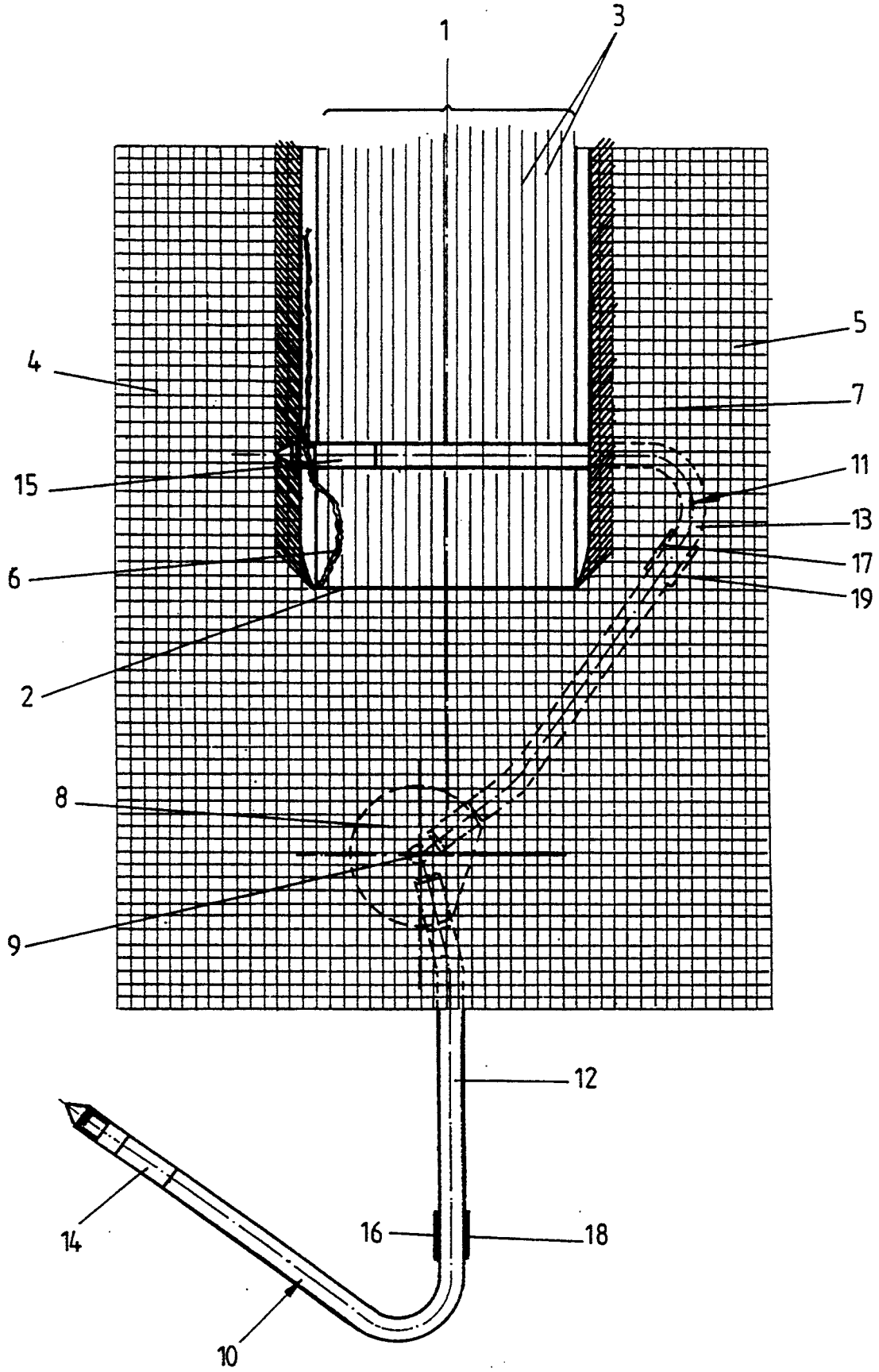
FIG. 2 is a top plan view of the draw-through gripper in the takeover position together with the woven fabric to be made continuous.
Figure 3:
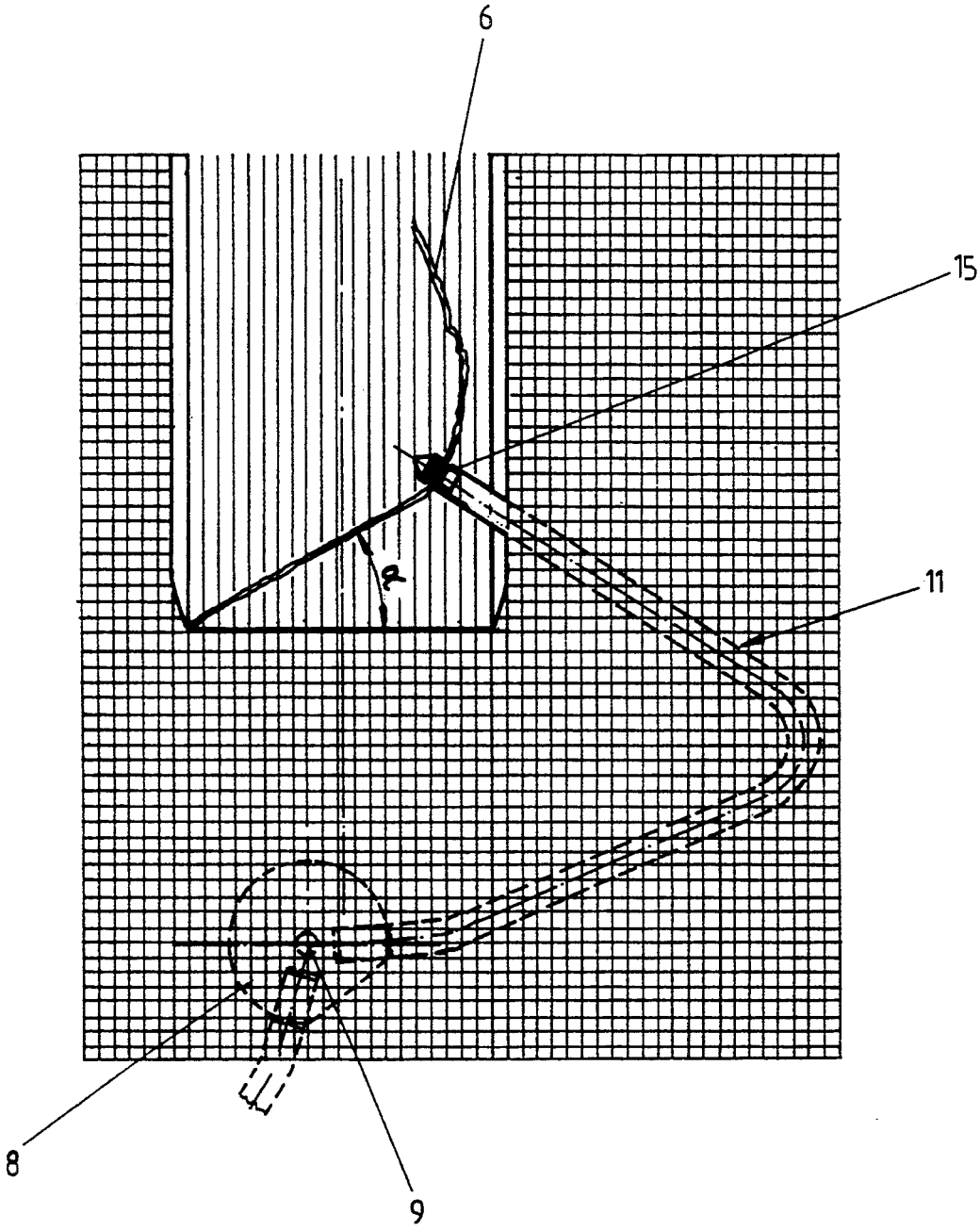
FIG. 3 is a top plan view of the draw-through gripper in the angle position in which the warp thread fringe being drawn through begins to experience the tensional force.
Figure 4:
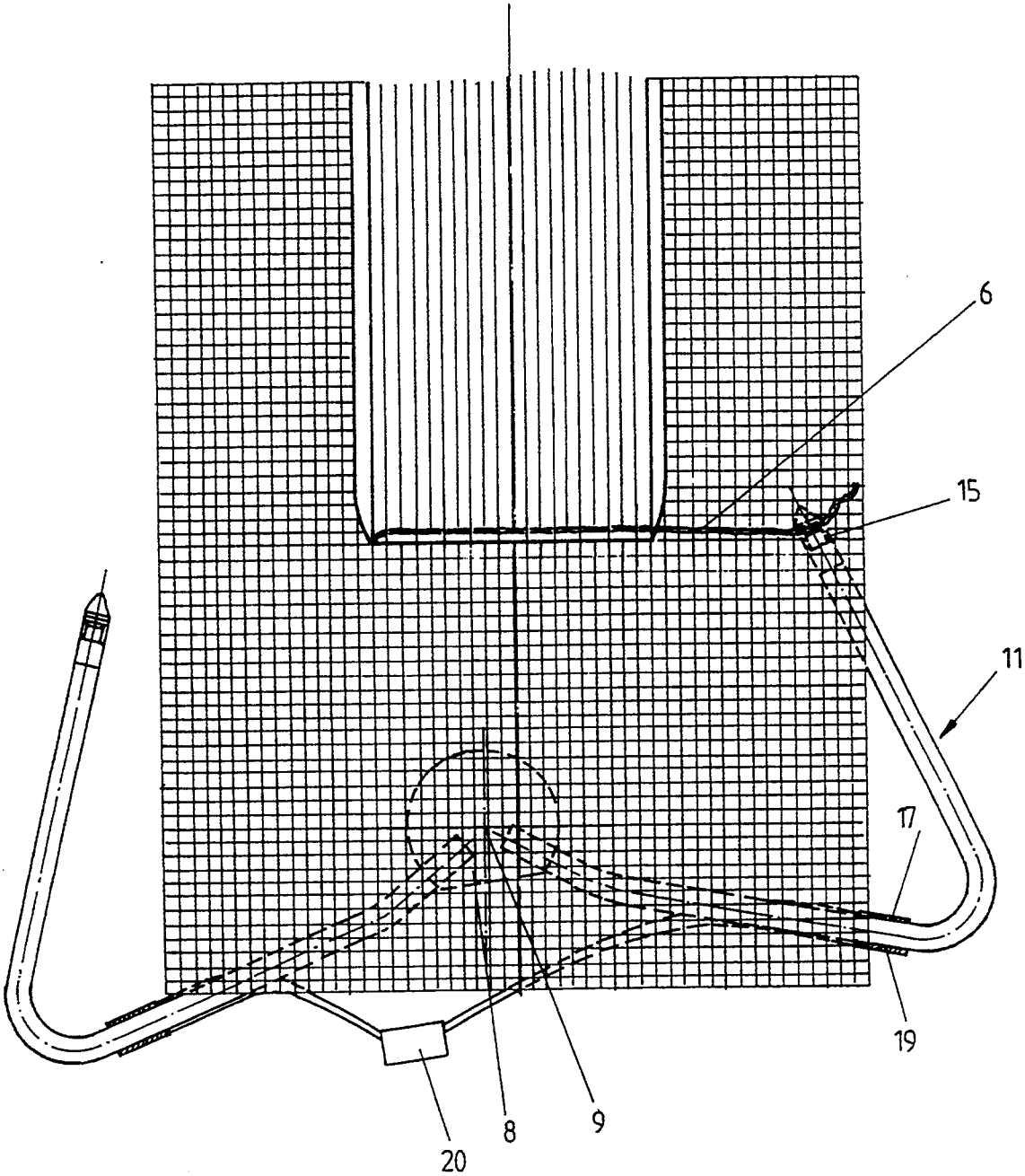
FIG. 4 is a top plan view of the draw-through gripper in an end-position with the warp thread fringe drawn through the weaving shed.

FIG. 2 shows the weaving shed 1 with the fell 2 and the auxiliary warp threads 3. Projecting from the woven fabric ends 4, 5 are warp thread fringes 6, 7 which are inserted into the seam-weaving shed by means of draw-through grippers 10, 11. Two draw-through grippers 10, 11 are represented, the draw-through gripper 10 arranged accordingly on the left-hand side in FIG. 1 drawing the warp thread fringes 7 starting from the woven fabric end 5 shown on the right-hand side through the weaving shed 1, and the draw-through gripper 11 represented accordingly on the right-hand side in FIG. 1 drawing the warp thread fringes 6 starting form the woven fabric end 4 on the left-hand side through the weaving shed 1. Each draw-through gripper 10, 11 consists of a gripping arm 12, 13 bent in a U-shape which is mounted for rotary movement at one end on a rotatable member 8 having a rotation axis 9 and has gripping collets 14, 15 at the other, front end. The draw-through grippers can also be rectilinearly movable instead of rotatably movable. The function sequence is in every case that the draw-through gripper 11 is moved through the seam-weaving shed 1 so that the gripping collet 15 is located at the woven fabric end 4. There, a warp thread fringe 6, isolated by a separator which is not shown and held fast by a handover gripper likewise not shown, is introduced into gripping collet 15 (FIG. 2). The draw-through gripper 11 then swivels, seen in FIGS. 2 to 4, in clockwise direction back through the seam-weaving shed 1 and thereby draws the warp thread fringe 6 through the weaving shed 1 (FIG. 3). The force exerted on the warp thread fringe 6 from the tightening (FIG. 3) to the end of this rotation movement (FIG. 4) can be influenced by the air pressure in the clamping cylinder of the gripping collet 15. This jerk upon reaching angle a (FIG. 3) of the drawing-through movement is important in order that the knuckles of the warp thread fringes and of the auxiliary warp threads engage true to position in the seam corner after the drawing through of the warp thread fringe and can lie inside each other in form-locking manner and true to position upon the subsequent shift through the reed which is not represented. This form locking is explained in more detail in utility model application G 92 11 353.2 dated Aug. 24, 1992 and entitled "Support for the reed of a seam-weaving machine" by the same applicant (=U.S. Ser. No. 08/110963).

The drawing through of the warp thread fringes 7 projecting from the woven fabric end 5 takes place in analogous manner through a rotary movement of the draw-through gripper 10. As the rotary movement of the draw-through grippers 10 and 11 takes place alternately and in opposed direction, they can be rotated about the rotation axis 9 connected rigidly to each other. The draw-through grippers 10 and 11 can however also be movable independently of each other.

Figure 5:
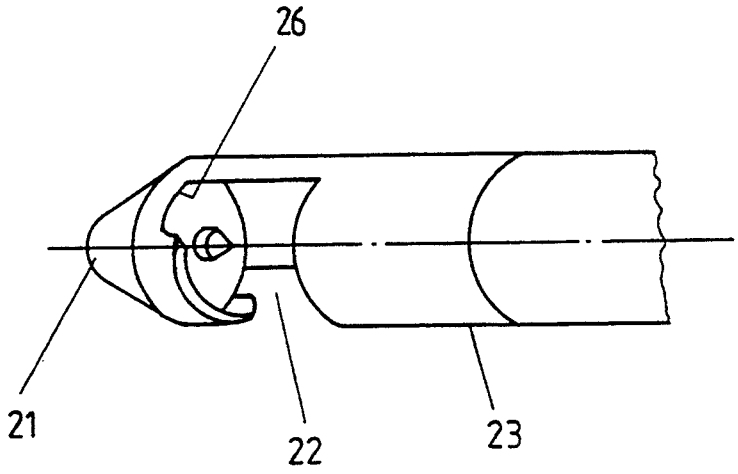
FIG. 5 is a detailed perspective view of the opened gripping collet in enlarged representation.
Figure 6:
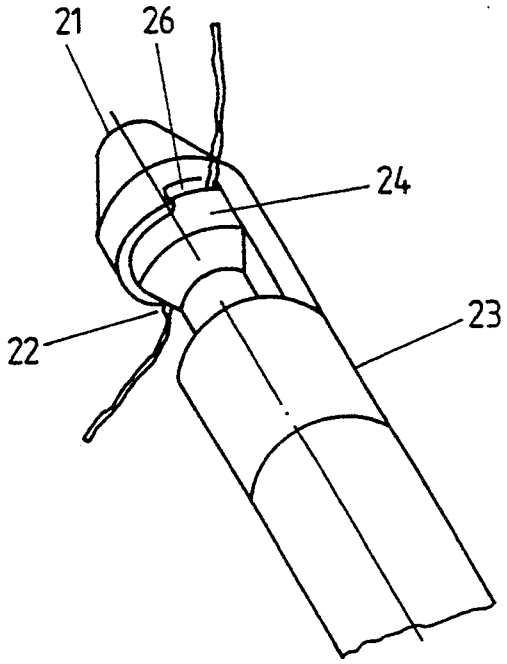
FIG. 6 is a detailed perspective view of the closed gripping collet in enlarged representation.

FIGS. 5 and 6 show the gripping collet 14, 15 in the opened and closed positions respectively. Each gripping collet 14, 15 has an end 21 ending in a tip behind which is found a recess 22 which is followed in turn by the tubular main section 23. Housed in the main section 23 is a clamping piston 24 which is pneumatically driven. A thread can be clamped fast in the recess 22 by means of this clamping piston 24, as shown in FIG. 6. The recess 22 is drawn somewhat forward at the bottom, so that, seen from the side, a right-angled notch 26 results in which the thread is clamped fast by the clamping piston 24 without the risk of the thread's slipping or being drawn out of the gripping collet 14, 15 in its transverse direction. The gripping collets 14, 15 are structurally simpler than the conventional gripping collets operating with an electrical contact, as all the parts needed for electricity, e.g. the plugs, sockets, insulation parts and cables inside the tubular gripper arm are unnecessary. Nor is there any need for the insulation required in conventional gripping collets between the clamping part and outer part of the gripping collets.

The bending moment exerted on the gripping arms 12, 13 depends on whether a warp thread fringe 6, 7 now serving as an auxiliary weft thread is introduced in the gripping collet 14, 15 and this bending moment is proportional to the force with which the auxiliary weft threads 6, 7 are drawn through the seam-weaving shed 1. As already mentioned, the increase in the bending moment occurring at angle position a (FIG. 3) of the drawing-through movement is of importance in particular for the reproducibility and quality of the woven seam.

The bending moment occurring in the gripping arms 12, 13 can be measured by a customary measurement apparatus with electro-mechanical sensors. With the embodiment described here, strain gauges 16 and 18 are arranged at opposite points of the gripping arm 12 at the greatest possible lever arm and strain gauges 17 and 19 at gripping arm 13 in the same way. The strain gauges can also be placed elsewhere if the signal size is adequate. These strain gauges 16 to 19 are sensors whose electrical resistance is greatly influenced by very small changes in length. The electrical resistance of the strain gauges can therefore be used as a measurement of mechanical strains and stresses. The arrangement of strain gauges 16 to 19 at the greatest possible lever arm makes sense, as the greatest bending moment occurs here. A limit-value amplifier 20 (FIG. 1) is connected downstream from the strain gauges 16 to 19 and the signal emerging from the strain gauges 16 to 19 is processed in such a way that the seam-weaving machine is stopped if these signals indicate that a specific lower limit value of the bending moment is not being reached towards the end of the drawing-through movement. It is also possible to ascertain from the pattern of the signal whether the auxiliary weft thread is broken; this is recognizable by a sudden drop in the bending moment. The four strain gauges 16 to 19 are connected together to form a measuring bridge. This measuring bridge can be attached complete to a gripper 12 or 13, and can also be divided as a half-bridge in each case between two grippers 12, 13. The strain gauges 16 to 19 are attached to the tube of the gripper arm 12, 13 in such a way that one strain gauge 16, 17 is located on the inside and the other strain gauge 18, 19 on the outside. Upon loading, i.e. when mechanical stress occurs at the gripper arm 12, 13, the strain gauge 16, 17 lying on the inside is compressed, while the strain gauge 178, 19 lying on the outside is extended. A particularly large signal level results from this arrangement. This signal is evaluated by the limit-value amplifier 20, in which a switching point can be variably set. The mechanical stress can thereby be precisely measured and, if the set minimum mechanical stress value is not reached, the seam-weaving machine can be stopped by a signal to a conventional control system.

While the invention has been particularly shown and described with reference to preferred embodiments thereof, it will be understood by those in the art that the foregoing and other changes in form and details may be made therein without departing from the spirit and scope of the invention.

What is claimed is:

1. A draw-through gripper for the gripping and inserting of an auxiliary weft thread into a seam-weaving shed in a seam-weaving machine comprises a movable gripper arm having a gripping collet at one end for grasping the auxiliary weft thread and measuring means for measuring the mechanical stress occurring inside the gripper arm mounted on the gripper arm intermediate opposite ends thereof.

2. A draw-through gripper according to claim 1, wherein said measuring means is comprised of strain gauges.

3. A draw-through gripper according to claim 1, wherein said gripper arm is mounted on a rotatable member and said measuring means for measuring the mechanical stress occurring inside the gripper arm is attached to the gripper arm at a distance from said rotatable member to provide the greatest possible lever arm.

4. A draw-through gripper according to claim 1, wherein said measuring means is comprised of two separate measuring means mounted on opposite sides of the gripper arm.

* * * * *